US006304182B1

(12) United States Patent
Mori et al.

(10) Patent No.: US 6,304,182 B1
(45) Date of Patent: Oct. 16, 2001

(54) APPARATUS FOR DETECTING THEFT BY A RADIO WAVE

(75) Inventors: Tomohiro Mori; Takanori Endo; Kouichi Ishiyama; Tadashi Yonezawa; Masami Miyake, all of Omiya; Shigeyuki Osawa, Noda; Seiro Yahata, Tokyo, all of (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/220,443

(22) Filed: Dec. 24, 1998

(30) Foreign Application Priority Data

Dec. 25, 1997 (JP) ..... 9-356571
Jan. 30, 1998 (JP) ..... 10-018895

(51) Int. Cl.[7] ..... G08B 13/14

(52) U.S. Cl. ..... 340/572.1; 340/545.6; 340/568.1; 340/570; 340/571; 340/572.5; 340/572.6

(58) Field of Search ..... 340/572.1, 570, 340/569, 571, 572.2, 572.4, 572.5, 572.6, 572.7, 572.8, 568.1, 568.6, 568.7, 568.8, 545.6

(56) References Cited

U.S. PATENT DOCUMENTS 3,665,448 * 5/1972 McGlinchey et al. ..... 340/280
3,720,940 * 3/1973 Fox et al. ..... 343/6 R
3,828,341 8/1974 Carter, Jr. et al. .
3,938,044 2/1976 Lichtblau .
4,136,338 * 1/1979 Antenore ..... 340/551
4,679,035 * 7/1987 Pfaff et al. ..... 340/572
4,831,363 * 5/1989 Wolf ..... 340/572
4,851,815 * 7/1989 Enkelmann ..... 340/571
4,862,160 * 8/1989 Ekchian et al. ..... 340/825.54
5,406,262 4/1995 Herman et al. .
5,963,134 * 10/1999 Bowers et al. ..... 340/572.1
5,973,596 * 10/1999 French et al. ..... 340/568.6
5,977,875 * 11/1999 Lin et al. ..... 340/570

FOREIGN PATENT DOCUMENTS 2 230 164 10/1990 (GB) .

* cited by examiner

*Primary Examiner*—Nina Tong
(74) *Attorney, Agent, or Firm*—Oblon, Spivak, McClelland, Maier & Neustadt, P.C.

(57) ABSTRACT

A burglar detection apparatus has a tag 11 that includes a resonance circuit. The tag is preferably contained with an object 15 whose theft is desired to be detected. The tagged object may be placed in a drawer 14 which is contained in a box 13. A tag detection sensor 16 is installed in the box and detects whether the tag 11 is present in the drawer 14. Also, a drawer sensor 17 detects whether the drawer is opened. Based on respective detection outputs of the tag detection sensor 16 and the drawer sensor 17, a control circuit 19 controls an alarm 18. Advantageously, the apparatus can be installed in a comparatively small space, does not malfunction even if subjected to large amounts of electrical noise, and reliably detects the presence or absence of a tag even if the tag is located near a metal object.

22 Claims, 10 Drawing Sheets

16 TAG DETECTION SENSOR
17 REED SWITCH (DRAWER SENSOR)
18 FIRST BUZZER (ALARM MEANS)
19 AND CIRCUIT (CONTROL CIRCUIT)
22 SOFT MAGNETIC MEMBER

23a CORE
23b COIL
23c, 23d ARMS
26 WAVE ABSORBER

11 TAG
15 BANK (NOTES)
18 FIRST BUZZER (ALARAM MEANS)
19 AND CIRCUIT (CONTROL CIRCUIT)
63 SAFE (BOX)
63b UPPER LID
66 TAG DETECTION SENSOR
67 MICRO SWITCH (UPPER LID SWITCH)

72 SOFT MAGNETIC MEMBER
73 LOOP ANTENNA
76 WAVE ABSORBER
91 SELF OPERATION MANAGEMENT CIRCUIT

APPARATUS FOR DETECTING THEFT BY A RADIO WAVE

TECHNICAL FIELD

The present invention relates to an apparatus detecting a burglar by detecting with using an radio wave whether a tag having a resonance circuit block is in a predetermined location and the like.

BACKGROUND ART

Heretofore, a tag is disclosed in Japanese Unexamined Patent Publication No. 8-185584, the tag which is constructed such that a resonance circuit block of the tag attached to an object for monitoring a burglar resonates with a specific frequency from a radio wave transmission unit, separation detection means detects whether the tag is separated from the object for monitoring a burglar, and a separation information block controls warning sound output means on the basis of a detection output of this separation detection means. In this burglar-alarm tag, the resonance circuit block is constructed with forming conductive metal foil, having a predetermined shape, by etching and the like in both sides of a thin film of an insulating dielectric. For example, a coil portion formed in a spiral shape with conductive metal foil, and a surface-side planer pattern of a capacitor, connected to the coil portion, in the central portion of the spiral of this coil portion are formed on the surface of the thin film.

In an entrance of an outlet selling the object for monitoring a burglar, a transmission antenna and a reception antenna are installed in a predetermined interval, and these antennas are electrically connected to a control block. The control block is constructed such that the control block makes the transmission antenna transmit a radio wave having a frequency resonating in the resonance circuit block and always checks a signal level of a signal received from the reception antenna. Furthermore, a speaker sounding an alarm is connected to a control output terminal of the control block.

With using a burglar-alarm tag constructed in this manner, a radio wave transmitted from a transmission antenna resonates in a resonance circuit block of the tag attached to an object for monitoring a burglar if an object for monitoring a burglar passes between the transmission antenna and a reception antenna without payment. Hence, the reception antenna receives an input signal whose reception level is modulated. In consequence, the control block sounds an alarm from a speaker and can check takeout of an unpaid product. In regard to a paid-up product, a tag is disabled by breaking a capacitor through applying a strong radio wave, or an alarm is disabled by temporarily stopping the alarm speaker.

Nevertheless, the above burglar-alarm tag requires a transmission antenna and a reception antenna, which are comparatively large, so as to detect a burglar of a product with the tag. Therefore, this type of tag has a defect that a comparatively wide space is required as an installation space of these antennas.

In addition, the above burglar-alarm tag has a possibility of a malfunction in a location with plenty of electrical noise of a computer and the like.

Furthermore, in regard to the above burglar-alarm tag, a central line of the helical coil portion extends in the direction orthogonal to a mounting surface of an object, and hence a radio wave transmitted from the resonance circuit block passes the object. Therefore, if this tag is attached on an object whose surface is made of conductive material such as aluminum or ferromagnetic material such as a steel sheet, self inductance of the coil portion changes. Hence, in comparison with a case that the tag is attached to an object whose surface is made of insulating-material or non-magnetic material, the tag has a possibility of not operating as a burglar-alarm tag due to an influence of a change of a resonance frequency in the resonance circuit block and the like.

DISCLOSURE OF INVENTION

An object of the present invention is to provide a radio wave type burglar detection apparatus that can be installed in a comparatively small space, can prevent a malfunction even if the apparatus is installed in a location with plenty of electrical noise, and can surely detect the presence and absence of a tag even if the tag is placed in the vicinity of an object made of metal.

Another object of the present invention is to provide a radio wave type burglar detection apparatus that can increase a ratio (SIN ratio) between a signal transmitted by the tag detection sensor and a signal generated by electrical noise of a computer and the like by making a radio wave, which is transmitted by the tag detection sensor, have directivity.

Still another object of the present invention is to provide a radio wave type burglar detection apparatus that can immediately detect abnormal operation caused by a failure and the like of a tag, a tag detection sensor, a drawer sensor, or an upper lid sensor, and hence can increase the reliability of the apparatus.

The embodiment of the invention shown in FIGS. 1 and 3 is a radio wave type burglar detection apparatus comprising: a tag 11 that has a resonance circuit block 12 and is placed with an object 15 in a predetermined location; a tag detection sensor 16 that is installed in the vicinity of the tag 11 placed in the predetermined location and detects whether the tag 11 is present in the predetermined location; and a control circuit 19 controlling alarm means 18 on the basis of an detection output of the tag detection sensor 16.

Since the tag detection sensor 16 detects that the tag 11 is present in the predetermined location if the tag 11 is placed in the predetermined location with the object 15, the control circuit 19 does not activate the alarm means 18. In addition, if the tag 11 is taken out from the predetermined location with the object 15, the tag detection sensor 16 detects that the tag 11 is not present in the predetermined location, and hence the control circuit 19 activates the alarm means 18.

The embodiment of the invention shown in FIGS. 1 and 3 is a radio wave type burglar detection apparatus comprising: a tag 11 having a resonance circuit block 12; a box 13 containing a drawer 14 where the tag 11 is contained with an object 15; a tag detection sensor 16 that is installed in the box 13 and detects whether the tag 11 is present within the drawer 14; a drawer sensor 17 detecting whether the drawer 14 is drawn; and a control circuit 19 controlling alarm means 18 on the basis of each detection output of the tag detection sensor 16 and drawer sensor 17.

In this radio wave type burglar detection apparatus, since the drawer sensor 17 detects that the drawer 14 is not drawn if the drawer 14 is contained in the box 13, the control circuit 19 does not activate the alarm means 18 regardless of whether the tag 11 is present within the drawer 14 or not. In addition, if the drawer 14 is drawn from the box 13, the drawer sensor 17 detects that the drawer 14 is drawn, and at the same time, the tag detection sensor 16 detects that the tag 11 is present within the drawer 14. Therefore, the control circuit 19 does not activate the alarm means 18. Furthermore, if the tag 11 is taken out with the object 15 from the drawer 14 with drawing the drawer 14, the tag detection sensor 16 detects that the tag 11 is not present within the drawer 14. Therefore, the control circuit 19 activates the alarm means 18.

The embodiment of the invention shown in FIG. 7 is a radio wave type burglar detection apparatus comprising: a tag 11 having a resonance circuit block; a box 63 that contains the tag 11 with an object 15 and has an upper lid 63*b* that can be opened and closed; a tag detection sensor 66 that is installed in the box 63 and detects whether the tag 11 is present within the box 63; an upper lid sensor 67 detecting whether the upper lid 63*b* is opened or closed; and a control circuit 19 controlling alarm means 18 on the basis of each detection output of the tag detection sensor 66 and upper lid sensor 67.

In this radio wave type burglar detection apparatus, since the upper lid sensor 67 detects that the upper lid 63*b* is not opened if the upper lid 63*b* is closed, the control circuit 19 does not activate the alarm means 18 regardless of whether the tag 11 is present within the box 63 or not. In addition, if the upper lid 63*b* is opened, the upper lid sensor 67 detects that the upper lid 63*b* is opened, and the tag detection sensor 66 detects that the tag 11 is present within the box 63. Therefore, the control circuit 19 does not activate the alarm means 18. Furthermore, if the tag 11 is taken out with the object 15 from the box 63 with opening the upper lid 63*b* , the tag detection sensor 66 detects that the tag 11 is not present within the box 63. Therefore, the control circuit 19 activates the alarm means 18.

The embodiment of the invention shown in FIG. 1 is characterized in that a tag 11 is placed in one piece with an object 15 in a predetermined location.

In this radio wave type burglar detection apparatus, if the object 15 is taken out from the predetermined location, the tag 11 also is taken out from the predetermined location surely, and hence a burglar of the object 15 can be surely detected.

The embodiment of the invention shown in FIG. 1 or 7 is characterized in that a tag 11 is contained in one piece with an object 15 in a drawer 14 or box 63.

In this radio wave type burglar detection apparatus, if the object 15 is taken out from the drawer 14 or box 63, the tag 11 also is taken out from the drawer 14 or box 63 surely, and hence a burglar of the object 15 can be surely detected.

The embodiment of the invention shown in FIGS. 1 and 3 or 7 is characterized in that a drawer 14 or a box 63 is made of metal material, and a soft magnetic member 22 or 72 is sandwiched between a tag 11 and the drawer 14 or box 63.

This embodiment of the invention is characterized in that a soft magnetic member is made of a sintered ferrite, a compact of ferrite powder and binder, or composite material of soft magnetic metal powder.

In this radio wave type burglar detection apparatus, a magnetic field can easily pass to a resonance circuit block 12 of a tag 11 owing to the soft magnetic member 22 or 72. Hence, even if a drawing 14 or a box 63 is made of metal material, the tag 11 can be surely detected by a tag detection sensor 16 or 66.

The embodiment of the invention shown in FIG. 1 is characterized in that a tag detection sensor 16 has a core 23*a*, where a coil 23*b* is wound, and at least a part of the core 23*a*, which does not face to a tag 11, is covered with the coil 23*b* by either or both of a wave absorber 26 and an electromagnetic wave shielding member.

In this radio wave type burglar detection apparatus, even if the radio wave type burglar detection apparatus of the present invention is installed in a location with plenty of electrical noise of a computer and the like, the electrical noise is absorbed by the wave absorber 26 and is cut off by the electromagnetic wave shielding member. Therefore, injection of the electrical noise into the core 23*a* of the tag detection sensor 16 is blocked, and hence it is possible to prevent the radio wave type burglar detection apparatus of the present invention from malfunctioning.

The embodiment of the invention shown in FIG. 7 is characterized in that a tag detection sensor 66 has a loop antenna 73, and a surface of the loop antenna 73, which does not face to a tag 11, is covered by either or both of a wave absorber 76 and an electromagnetic wave shielding member.

In this radio wave type burglar detection apparatus, even if the radio wave type burglar detection apparatus of the present invention is installed in a location with plenty of electrical noise of a computer and the like, the electrical noise is absorbed by the wave absorber 26 and is cut off by the electromagnetic wave shielding member. Therefore, injection of the electrical noise into the loop antenna 73 of the tag detection sensor 66 is blocked, and hence it is possible to prevent the radio wave type burglar detection apparatus of the present invention from malfunctioning.

The embodiment of the invention shown in FIG. 1 is characterized in that a pair of arm sections 23*c* and 23*d* made of ferrite is provided at both ends of the core 23*a* with protruding toward a tag 11.

In this radio wave type burglar detection apparatus, a radio wave transmitted from the pair of arm sections 23*c* and 23*d* proceeds toward the tag 11, that is, it is possible to make the radio wave have directivity. Therefore, it is possible to increase a ratio (S/N ratio) between a signal transmitted by the arm sections 23*c* and 23*d* and a signal generated by electrical noise of a computer and the like.

The embodiment of the invention shown in FIG. 9 or 10 comprises a self operation management circuit 81 or 91 detecting abnormal operation of a tag 11, a tag detection sensor 16 or 66, or a drawer sensor 17.

In this radio wave type burglar detection apparatus, if the tag 11, tag detection sensor 16 or 66, or drawer sensor 17 abnormally operates due to a failure and the like, the self operation management circuit 81 or 91 are immediately detect the abnormal operation. Therefore, it is possible to rapidly repair or replace the tag 11 or the like which abnormally operates.

BEST MODE FOR CARRYING OUT THE INVENTION

Figure 1:
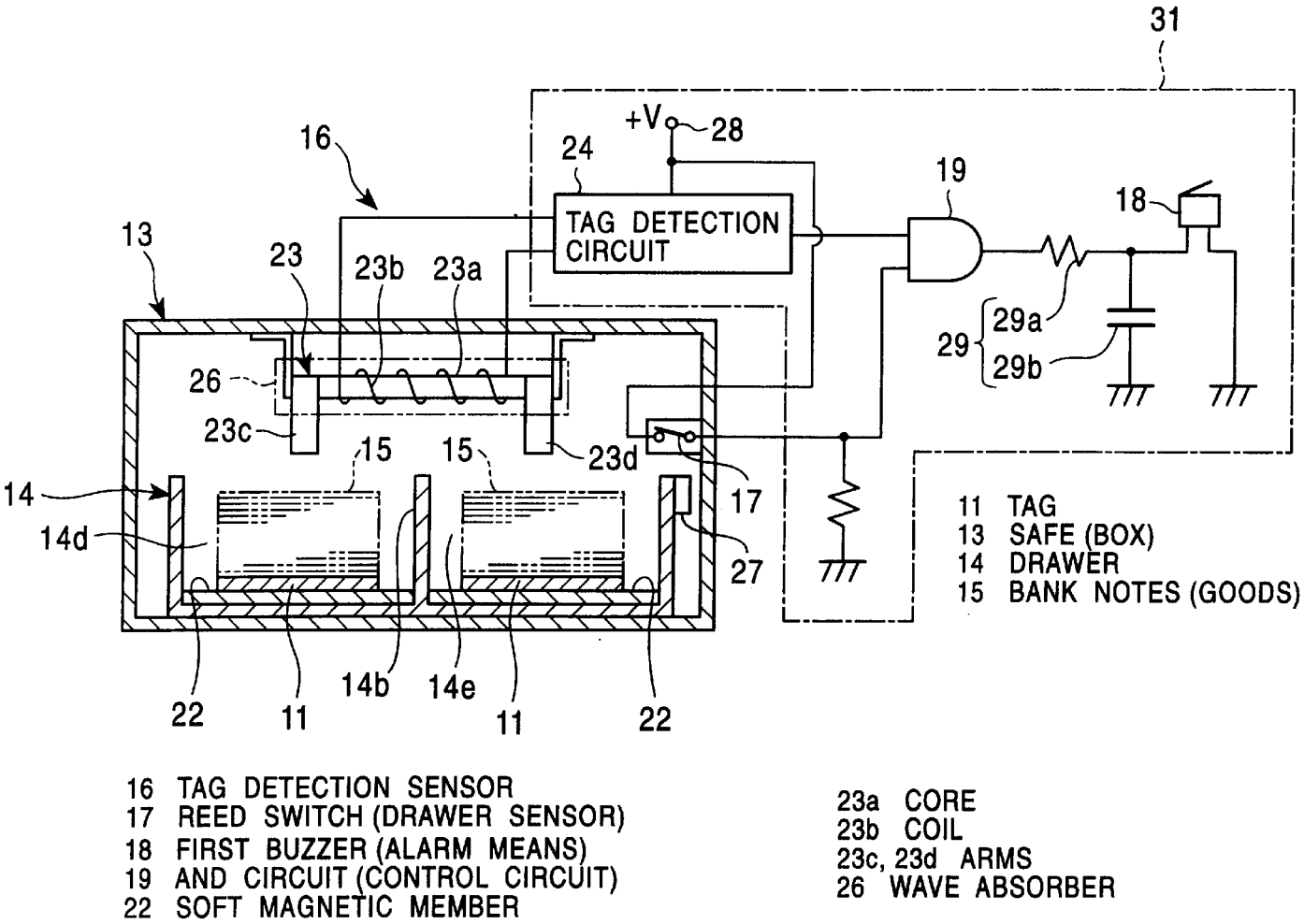
FIG. 1 is a block diagram showing a radio wave type burglar detection apparatus according to a first embodiment present invention.
Figure 3:
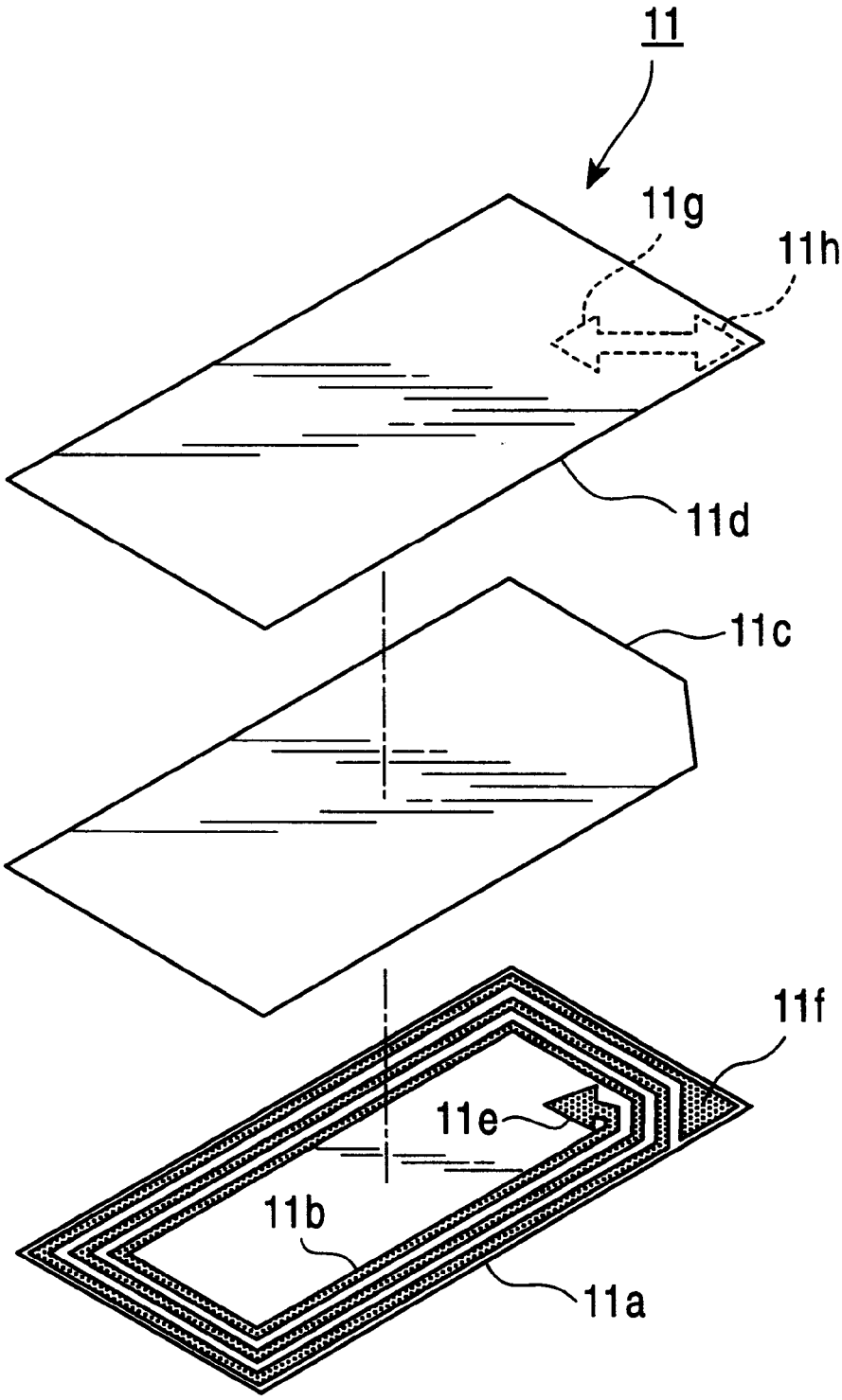
FIG. 3 is an exploded perspective view of a tag in the radio wave type burglar detection apparatus.
Figure 4:
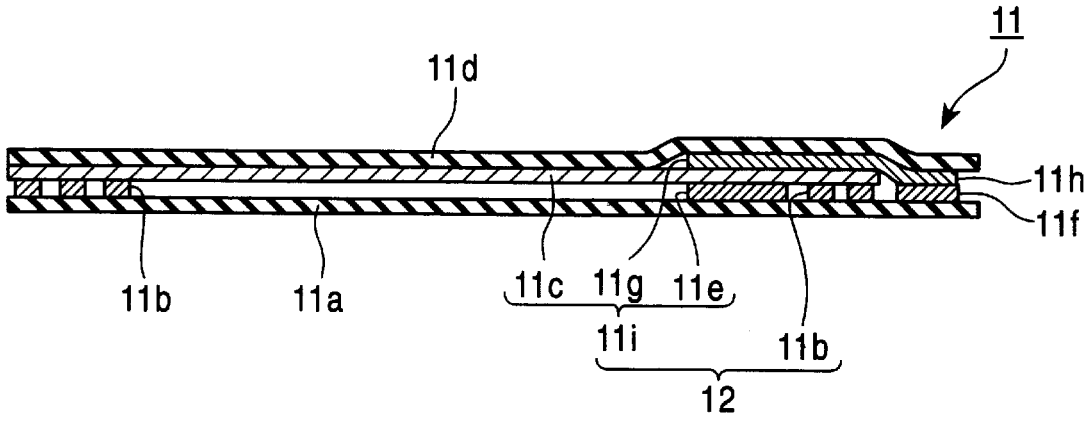
FIG. 4 is a vertical cross-sectional view of the tag.

Next, a form of a first embodiment of the present invention will be described on the basis of drawings. A radio wave type burglar detection apparatus, as shown in FIGS. 1 and 3, comprises: a tag 11 having a resonance circuit block 12; a box 13 containing a drawer 14 where the tag 11 is contained with an object 15; a tag detection sensor 16 detecting whether the tag 11 is present within the drawer 14; a drawer sensor 17 detecting whether the drawer 14 is drawn; and a control circuit 19 controlling alarm means 18 on the basis of each detection output of the tag detection sensor 16 and drawer sensor 17. The tag 11 is formed in the approximately same shape as that of the object 15 in this embodiment. This tag 11, as shown in FIGS. 3 and 4, comprises: a base plate 11*a* made of insulating-material such as paper and a plastic thin sheet; a coil portion 11*b* that is made of conductive material such as copper and aluminum and is formed in a helical and approximately rectangular shape on the upper surface of this base plate 11*a*; a dielectric layer 11*c* that is made of insulating-material and is bonded to cover the upper surface of the base plate 11*a* through the coil portion 11*b*; and a surface layer 11*d* that is made of insulating-material and is bonded to cover the upper surface of the dielectric layer 11*c*.

On the upper surface of the base plate 11*a*, a first electrode layer lie and a first connecting terminal 11*f* that are made of conductive material and are electrically connected to an internal end and an external end of the coil portion 11*b* are bonded respectively. The dielectric layer 11*c* is bonded to cover a part of the upper surface of the base plate 11*a* except the first connecting terminal 11*f*. In addition, on the bottom surface of the surface layer 11*d*, a second electrode layer 11*g* and a second connecting terminal 11*h* that are made of conductive material and face to the first electrode layer 11*e* and first connecting terminal 11*f* are bonded respectively. The second electrode layer 11*g* and second connecting terminal 11*h* are electrically connected with each other. The first and second connecting terminals 11*f* and 11*h* are electrically connected with each other when the surface layer 11*d* is laminated through the dielectric layer 11*c* on the base plate 11*a*. In addition, a capacitor 11*i* is constructed with the first electrode layer 11*e*, first dielectric layer 11*c*, and second electrode layer 11*g*, and a resonance circuit block 12 is constructed with this capacitor 11*i* and coil portion 11*b*. A resonance frequency of the resonance circuit block 12 is 7–9 MHz in this embodiment.

The box 13 is a safe where the drawer 14 is contained, and the object 15 is plenty of bank notes (FIGS. 1 and 2). The drawer 14 is partitioned into a document container 14*c*, which is in a near end, and bank note containers 14*d* and 14*e*, which are in a back end, with a first partition board 14*a* extending in the width direction. The bank note containers 14*d* and 14*e* are partitioned into a pair of bank note containers 14*d* and 14*e*, which are partitioned into a left part and a right part respectively, with a second partition board extending in the drawing direction. This drawer 14 is made of metal material such as a steel sheet, the tags 11 and 11 are contained in the pair of bank note containers 14*d* and 14*e* respectively, and further, on these tags 11 and 11, plenty of bank notes 15 and 15 are piled respectively. In addition, soft magnetic members 22 and 22 are sandwiched between the tags 11 and 11, and the drawer 14.

Figure 2A:
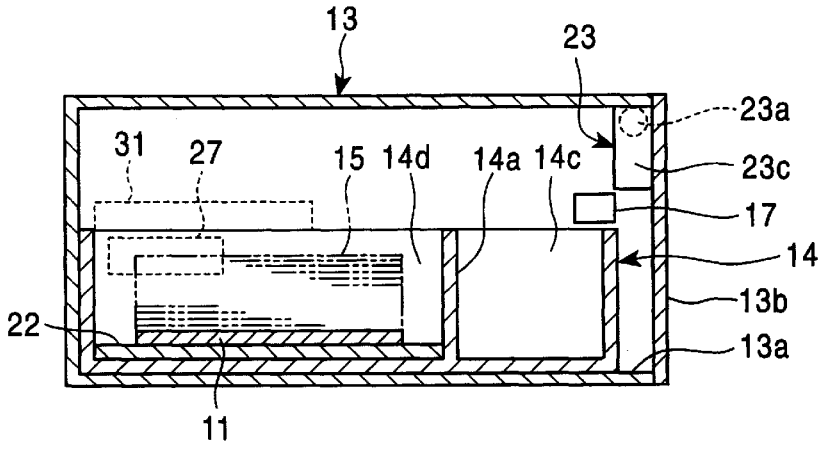
FIG. 2A is a vertical cross-sectional view of a safe in a state of a drawer being contained in the safe.
Figure 2B:
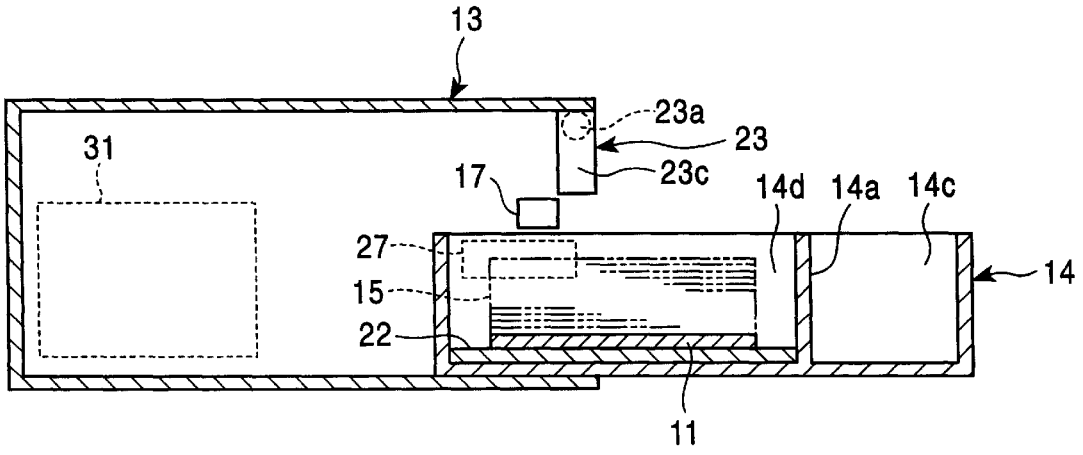
FIG. 2B is a vertical cross-sectional view of a safe in a state of the drawer being drawn from the safe.

It is preferable to use a sintered ferrite, a compact of ferrite powder and binder, or composite material of soft magnetic metal powder as this soft magnetic member. As the binder, polyester, nylon, polyvinyl chloride, synthetic rubber, natural rubber, and the like can be used. In addition, as the composite material of soft magnetic metal powder, composite material of carbonyl iron powder, permalloy powder by ball mill crushing, and the like, and resin such as polyester, nylon, polyvinyl chloride, synthetic rubber, and natural rubber can be used. The purpose of inserting the soft magnetic member 22 between the tag 11 and drawer 14 is to make it possible that a magnetic field easily passes to the resonance circuit block of the tag 11 owing to the soft magnetic member 22, and hence, that the tag 11 is surely detected by the tag detection sensor 16 even if the drawer 14 is made of metal. In addition, an opening 13*a* for drawing the drawer 14 is formed in the front panel of the safe 13, and this opening 13*a* is enabled to open and close by means of a front door 13*b* (FIGS. 2A and 2B).

The tag detection sensor 16 comprises an antenna 23 attached on a back surface of an upper wall in the vicinity of the opening 13*a* of the safe 13, and a tag detection circuit 24 electrically connected to a coil 23*b* of this antenna 23 (FIGS. 1, 2A, 2B, and 5). The antenna 23 has a core 23*a* that is made of ferrite and extends in the width direction of the safe 13, a coil 23*b* wound around this core 23*a*, and a pair of arm sections 23*c* and 23*d*, which is made of ferrite and is provided in both ends of the core 23*a* with protruding toward two tags 11 and 11 respectively. The core 23*a*, including the coil 23*b*, and a base end of the pair of arm sections 23*c* and 23*d* are covered with the wave absorber 26 (FIGS. 1 and 5) and electromagnetic wave shielding member (not shown) through an insulator (not shown) such as a vinyl tape. In addition, if the pair of arm sections is not provided in both ends of the core with protruding, the periphery of a part of a core except a part of the core facing to the tag, that is, both ends of the core can be covered with the coil through the insulator with the wave absorber and electromagnetic wave shielding member. In addition, regardless of the presence or absence of the pair of arm sections, a part of the core not facing to the tag can be covered with the coil through the insulator with the wave absorber and electromagnetic wave shielding member.

The wave absorber 26 is a nonwoven fabric type wave absorber, and a wave absorber is used, the wave absorber which is a wave absorber comprising a nonwoven fabric composed of first fibers which are covered by oxidized metal and second fibers that is an insulator and is not covered by metal. In addition, a wave absorber composed of laminated nonwoven fabric sheets composed of the first fibers and second fibers is used. Furthermore, a wave absorber comprising a nonwoven fabric composed of a plurality of laminated layers composed of at least one layer of nonwoven fabric containing oxidized metal-coated fibers and one layer of nonwoven fabric containing non-oxidized metal-coated fibers is also used, the nonwoven fabric having a layer containing the oxidized metal-coated fibers which is located in the injection surface side of a radio wave. As metal coating the fibers and being oxidized, one or two kinds of metal, alloys, or the like that are selected from a group of silver, copper, nickel, and zinc are used.

In addition, as the wave absorber 26, a wave absorber comprising a nonwoven fabric composed of first fibers, which is coated with metal that is sulfided, and second fibers, which is an insulator and is not coated with metal, can be used. Furthermore, a wave absorber comprising a plurality of laminated nonwoven fabric sheets composed of the first and second fibers can be also used. Moreover, a wave absorber comprising a nonwoven fabric composed of a plurality of laminated layers composed of at least one layer of nonwoven fabric containing sulfided metal-coated fibers and one layer of nonwoven fabric containing non-sulfided metal-coated fibers can be also used, the nonwoven fabric having a layer containing the sulfided metal-coated fibers which is located in the injection surface side of a radio wave. As metal coating the fibers and being sulfided, copper or a copper alloy is used.

In addition, it is preferable to use as an electromagnetic wave shielding member a nonwoven fabric comprising organic fibers coated with silver, a nonwoven fabric comprising a mixture of organic fibers and organic fibers coated with silver, or a laminated body comprising nonwoven fabrics comprising organic fibers and organic fibers coated with silver. Natural and synthetic organic fibers such as cotton, linen, regenerated cellulose, polyamide, acrylic fibers, polyolefine, polyester, and the like are used as the organic fibers. The purpose of coating the core 23*a*, including the coil 23*b*, and the pair of arm sections 23*c* and 23*d* with the wave absorber 26 and electromagnetic wave shielding member is to make it possible that electrical noise of a computer and the like is absorbed by the wave absorber 26 and is blocked from incidence into the core 23*a* of the antenna 23 by shutting off with the electromagnetic wave shielding member, and hence that a radio wave type burglar detection apparatus is prevented from malfunctioning. In addition, the purpose of providing the pair of arm sections 23*c* and 23*d* in both sides of the core 23*a* with protruding is to increase a ratio (S/N ratio) between a signal transmitted from the arm sections 23*c* and 23*d* and a signal generated by electrical noise of a computer and the like by a radio wave, transmitted from the pair of arm sections 23*c* and 23*d*, proceeding toward the tags 11 and 11, that is, making the radio wave have directivity.

Figure 5:
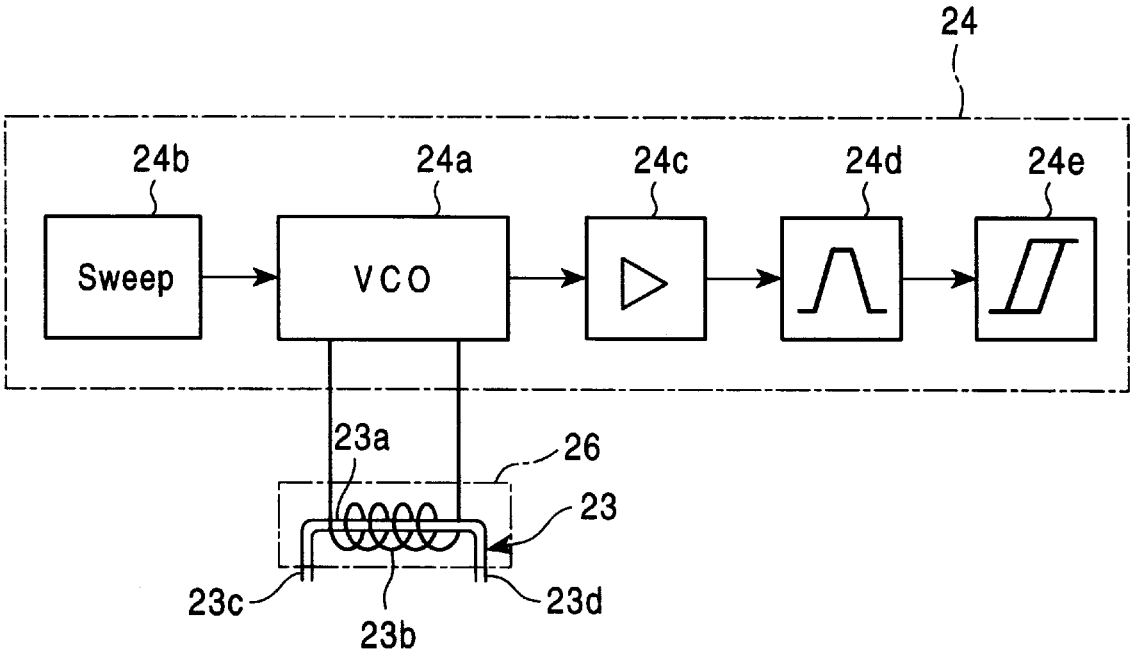
FIG. 5 is a block diagram of a tag detection circuit thereof.

The tag detection circuit 24, as shown in FIG. 5, comprises: a voltage-controlled oscillator 24*a* that is electrically connected to the coil 23*b* of the antenna 23 and feeds a current, having the same frequency as a resonance frequency of the tag 11, through the coil 23*b*; a sweep block 24*b* sweeping the oscillating frequency of this oscillator 24*a* within the range of 7–9 MHz; an amplifier 24*c* whose input terminal is connected to the output terminal of an automatic gain controller in the voltage-controlled oscillator 24*a*; a noise filter 24*d* whose input terminal is connected to the output terminal of the amplifier 24*c*; and a threshold circuit 24*e* whose input terminal is connected to the output of the noise filter 24*d*. This tag detection circuit 24 is constructed so that, when the resonance circuit block 12 resonates by the tag 11 accessing the coil 23*b*, a specific signal may appear at the output terminal of the automatic gain controller of the voltage-controlled oscillator 24*a*. This specific signal is amplified by the amplifier 24*c*, a noise signal mixed in this signal is filtered by the noise filter 24*d*, and further the signal is selected by the threshold circuit 24*e*. If a waveform of the specific signal is not present in a waveform selected by the threshold circuit 24*e*, the threshold circuit 24*e* outputs the ON signal "1". In addition, if a waveform of the specific signal is present in a waveform selected by the threshold circuit 24*e*, the threshold circuit 24*e* outputs the OFF signal "0".

The drawer sensor 17 is a reed switch (FIGS. 1 and 2) attached to one internal surface of a side wall in the vicinity of the opening 13*a* of the safe 13. In addition, a magnet 27 is attached to an external surface of a side wall in the vicinity of the back end of the drawer 14. If the drawer 14 is contained in the safe 13, the magnet 27 is separated from the reed switch 17, and hence the reed switch outputs the signal "0" with keeping the OFF state. If the drawer 14 is drawn, the magnet 27 accesses the reed switch 17, and hence the reed switch outputs the signal "1" with turning on. One terminal of this reed switch 17 is connected to a power supply 28, and another terminal is connected to a control input terminal of an AND circuit 19, which is a control circuit, with the output terminal of the threshold circuit 24*e* (FIGS. 1 and 5). A first buzzer 18, which is alarm means, is connected to the control output terminal of the AND circuit 19 (FIG. 1). The AND circuit 19 activates the first buzzer 18 only when the reed switch 17 outputs the signal "1" because of the drawer 17 being drawn and the threshold circuit 24*e* outputs the signal "1" because of the tag 11 not being present within the drawer 14.

A time constant circuit 29, which is composed of a resistor 29*a* and a capacitor 29*b*, is connected between the AND circuit 19 and first buzzer 18. When chattering at the output terminal of the threshold circuit 24*e* and the reed switch 17 arises, the time constant circuit 29 prevents the first buzzer 18 from malfunctioning. In particular, this is effective to a case that chattering arises at the output terminal of the threshold circuit 24*e* due to electrical noise that is caused by a cellular phone and the like and is not continuous but intermittent. The tag detection circuit 24, power supply 28, AND circuit 19, first buzzer 18, and time constant circuit 29 are contained in a case 31 attached to the external surface of a side wall of the safe 13 (FIGS. 1 and 2).

Operation of the radio wave type burglar detection apparatus constructed like this will be described.

If the drawer 14 is contained in the safe 13 and the front door 13*b* is closed (FIG. 2A), the magnet 27 is separated from the reed switch 17, and hence the reed switch 17 outputs the signal "0" with keeping the OFF state. Therefore, even if an ON signal "1" is outputted from the threshold circuit 24*e* because the tag detection sensor 16 cannot detect the tags 11 and 11 due to the tags 11 and 11 not facing to the antenna 23, the AND circuit 19 does not activate the first buzzer 18 on the basis of respective detection outputs of the reed switch 17 and tag detection sensor 16.

If the front door 13*b* of the safe 13 is opened and the drawer 14 is drawn in a state of being able to take the bank notes 15 out (FIG. 2B), the magnet 27 accesses the reed switch 17, and hence the reed switch 17 outputs the signal "1" owing to the magnetic intensity of the magnet 27 (FIG. 1). Nevertheless, since the tag 11 faces to the antenna 23, the tag detection sensor 16 detects the two tags 11 and 11, and hence the threshold circuit 24*e* outputs the signal "0". In consequence, the AND circuit 19 does not activate the first buzzer 18 on the basis of respective detection outputs of the reed switch 17 and tag detection sensor 16.

In addition, even if one of the two tags 11 and 11 is taken out from the drawer with the bank notes 15, the tag detection sensor 16 continues to detect another residual tag 11, and hence the threshold circuit 24*e* continues to output the signal "0". In consequence, the AND circuit 19 does not activate the first buzzer 18 on the basis of respective detection outputs of the reed switch 17 and tag detection sensor 16. This is because it is considered that an owner of the safe 13 counts the bank notes 15 in the safe 13.

Furthermore, if all of the tags 11 and 11 are taken out with the bank notes 15 and 15 from the drawer 14 in the state of the reed switch 17 outputting the signal "1", the tag detection sensor 16 detects that the tags 11 and 11 are not present in the drawer 14, and hence the threshold circuit 24*e* outputs the signal "1". In consequence, the AND circuit 19 activates the first buzzer 18 on the basis of respective detection outputs of the reed switch 17 and tag detection sensor 16. Therefore, an owner of the safe 13 can immediately know that the bank notes 15 in the safe 13 are taken out without notice by an alarm sounded by the first buzzer 18, and hence can instantly report the incident to the police.

Figure 6:
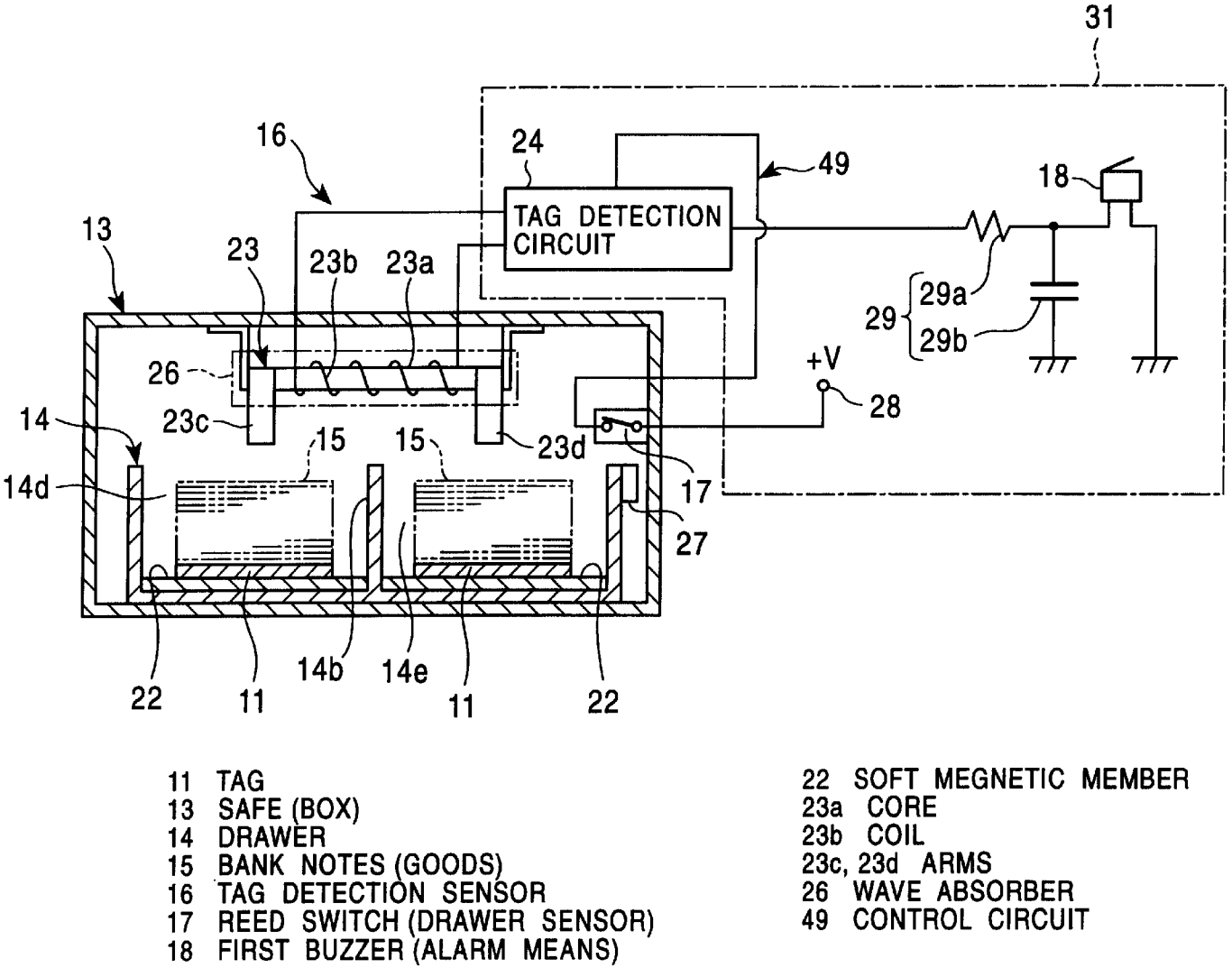
FIG. 6 is a block diagram that shows a second embodiment of the present invention and corresponds to FIG. 1.

FIG. 6 shows a second embodiment of the present invention. In FIG. 6, the same symbols are assigned to the same components as those in FIG. 1.

In this embodiment, the power supply 28 is connected in series to the tag detection circuit 24 through the reed switch 17, and this series circuit constructs a control circuit 49. Except the above construction this embodiment has the same construction as the first embodiment has.

Since the operation of a radio wave type burglar detection apparatus constructed like this is the approximately same as the operation of the first embodiment, repeated description will be omitted.

Figure 7:
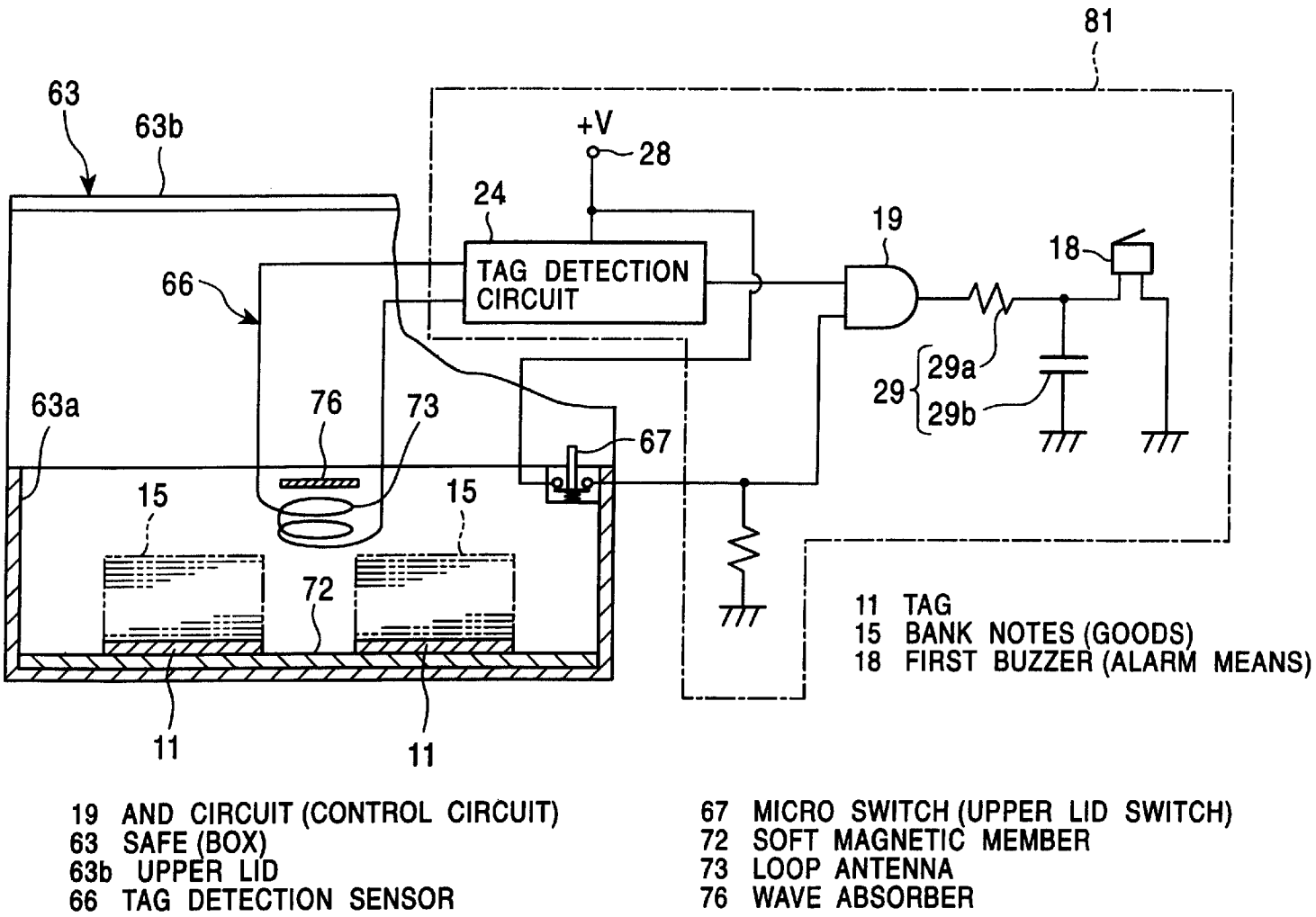
FIG. 7 is a block diagram that shows a third embodiment of the present invention and corresponds to FIG. 1.
Figure 8A:
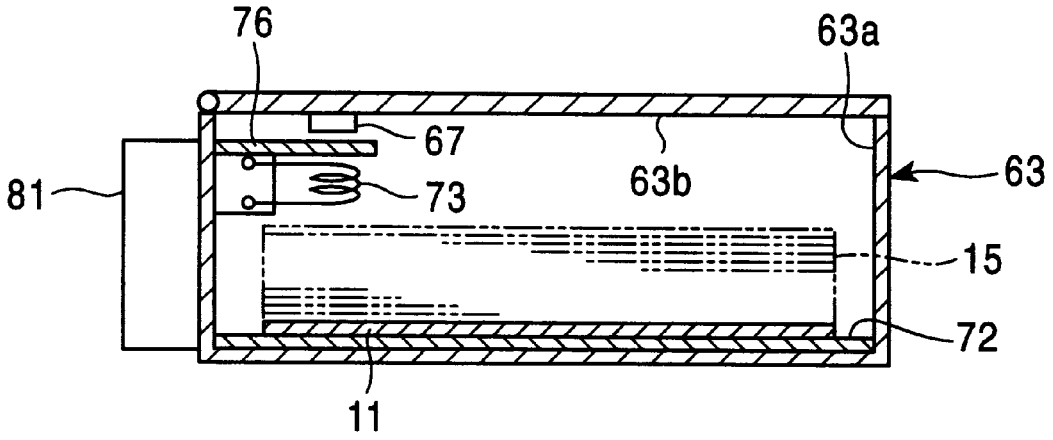
FIG. 8A is a vertical cross-sectional view of a safe in a state of an upper lid being closed.
Figure 8B:
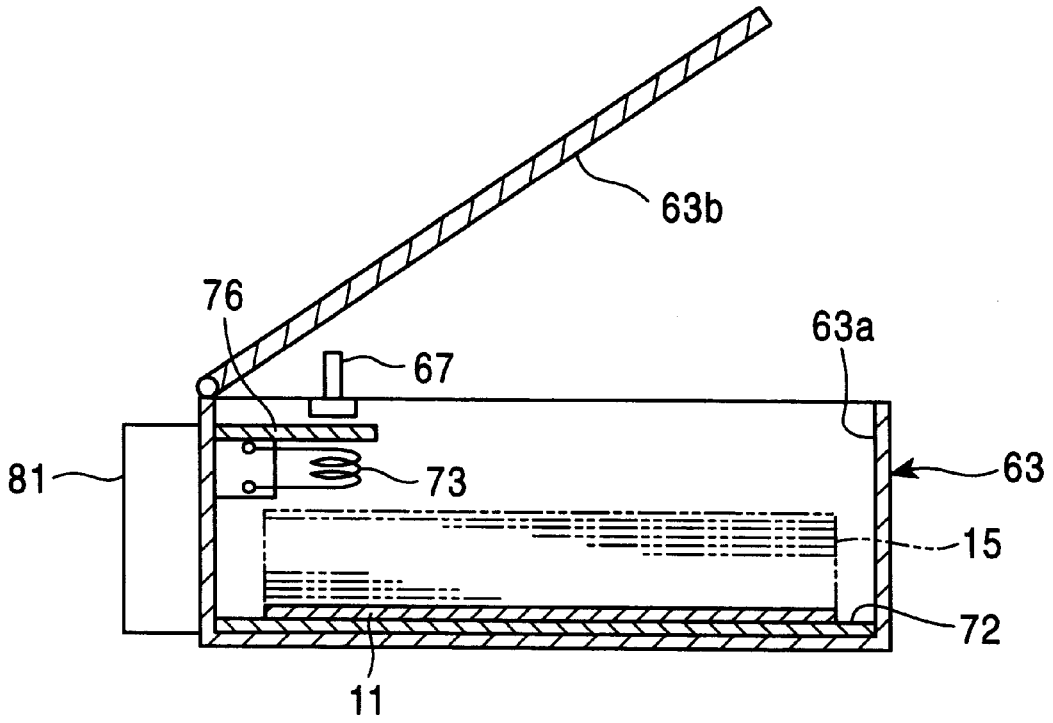
FIG. 8B is a vertical cross-sectional view of a safe in a state of an upper lid being opened.

FIGS. 7 and 8 show a third embodiment of the present invention. In FIGS. 7 and 8, the same symbols are assigned to the same components as those in FIGS. 1 and 2.

In this embodiment, an opening 63*a* is provided in the upper side of the safe 63 made of metal material, and an upper lid 63*b* that can open and close the opening 63*a* is installed in the upper surface of this safe 63. Furthermore, a loop antenna 73 that is circular or square and consists of a plurality of turns of wire is used as an antenna of a tag detection sensor 66. In the safe 63, a soft magnetic member 72 made of the same material as that of the soft magnetic member 22 in the first embodiment is placed, and two tags 11 and 11 are placed in parallel to each other on this soft magnetic member 72. Thus, the soft magnetic member 72 is sandwiched between the tags 11 and 11, and the safe 63. In addition, on these tags 11 and 11, plenty of bank notes 15 and 15 are piled respectively. The loop antenna 73 is placed to become above between the two tags 11 and 11 in the safe 63, and both ends of this antenna 73 are electrically connected to the tag detection circuit 24. In addition, the surface of the loop antenna 73 not facing to the tags 11 and 11 is covered by a wave absorber 76 and an electromagnetic wave shielding member (not shown) through an insulator (not shown).

In addition, an upper lid sensor 67 is mounted to the inside of a side wall in the vicinity of the opening 63*a* of the safe 63. This sensor 67 is a micro switch, which outputs the signal "0" with turning off at the time of closing the upper lid 63*b*, and which outputs the signal "1" with turning on at the time of opening the upper lid 63*b*. The AND circuit 19, which is a control circuit, activates the first buzzer 18 only when the micro switch 67 outputs the signal "1" because of the upper lid 63*b* being opened and a threshold circuit (not shown) in the tag detection circuit 24 outputs an ON signal "1" because of the tag 11 not being present within the safe 63. The tag detection circuit 24, power supply 28, AND circuit 19, first buzzer 18, and time constant circuit 29 are contained in a case 81 mounted to the external surface of a back wall of the safe 63. The construction of this embodiment except the above construction is the same as that of the first embodiment.

In the radio wave type burglar detection apparatus constructed like this, if the upper lid 63*b* is closed (FIG. 8A), the tag detection sensor 66 detects that the tags 11 and 11 are present in the safe 63, and hence the tag detection circuit 24 outputs the signal "0". Since the micro switch 67 outputs the signal "0", the AND circuit 19 does not activate the first buzzer 18. In addition, if the upper lid 63*b* is opened (FIG. 8B), the micro switch 67 outputs the signal "1" (FIG. 1), but the tag detection sensor 66 detects that the tags 11 and 11 are present in the safe 63, and hence the tag detection circuit 24 outputs the signal "0". In consequence, the AND circuit 19 does not activate the first buzzer 18.

In addition, even if one of the two tags 11 and 11 is taken out from the safe 63 with the bank notes 15, the tag detection sensor 66 continues to detect another residual tag 11 in the safe 63, and hence the tag detection circuit 24 continues to output the signal "0". In consequence, the AND circuit 19 does not activate the first buzzer 18. Furthermore, if all of the tags 11 and 11 are taken out with the bank notes 15 and 15 from the safe 63 in the state of the upper lid being opened (the micro switch 67 outputting the signal "1"), the tag detection sensor 66 detects that the tags 11 and 11 are not present in the safe 63, and hence the tag detection circuit 24 outputs the signal "1". Hence, the AND circuit 19 activates the first buzzer 18. In consequence, an owner of the safe 63 can immediately know that the bank notes 15 in the safe 63 are taken out without notice by an alarm sounded by the first buzzer 18, and hence can instantly report the incident to the police.

Figure 9:
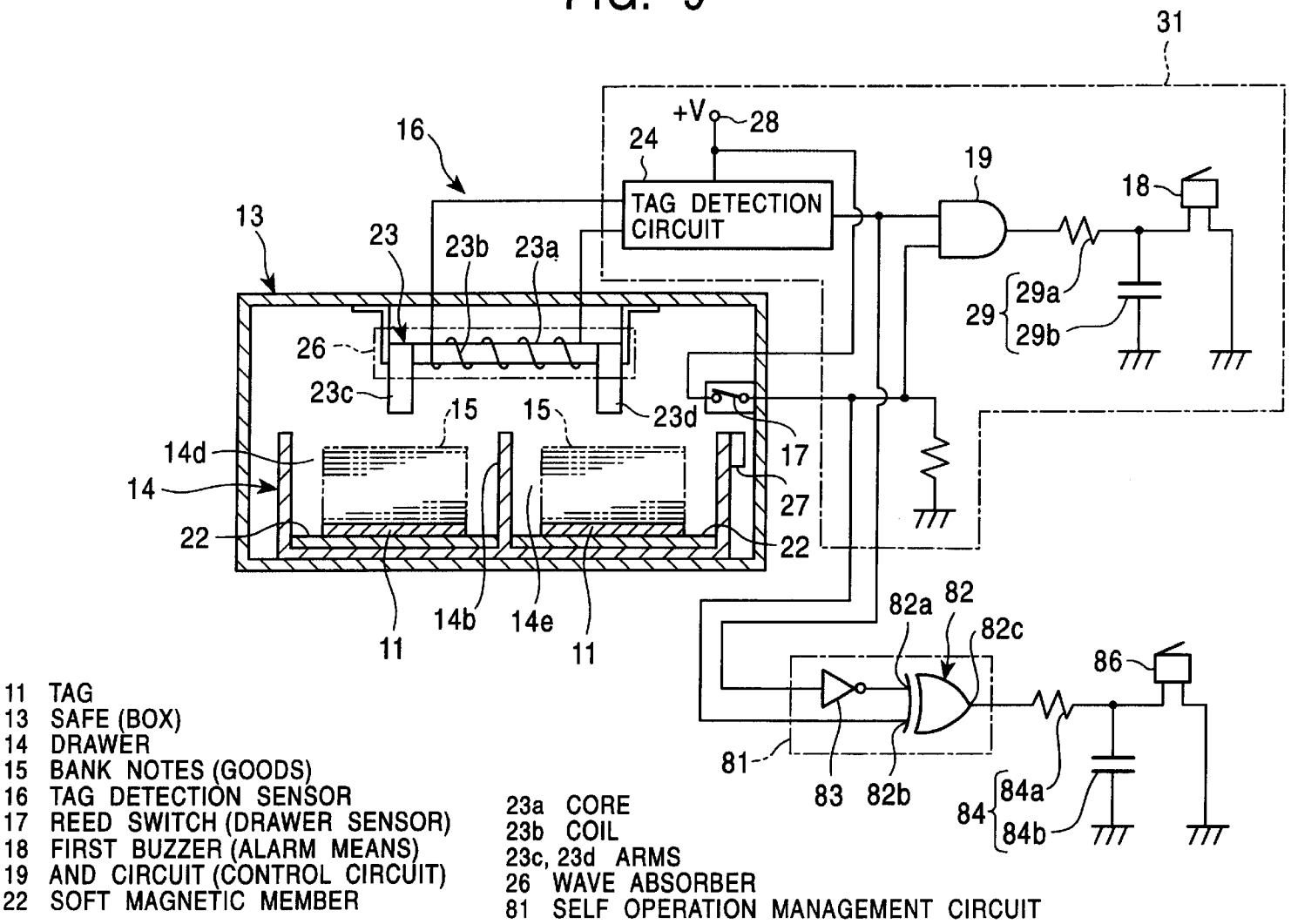
FIG. 9 is a block diagram that corresponds to FIG. 1 and shows a radio wave type burglar detection apparatus that comprises a self operation management circuit and is a fourth embodiment of the present invention.

FIG. 9 shows a fourth embodiment of the present invention. In FIG. 9, the same symbols are assigned to the same components as those in FIG. 1.

This embodiment comprises a self operation management circuit 81 detecting abnormal operation of the tag 11, tag detection sensor 16 or reed switch 17. This self operation management circuit 81 has an exclusive OR circuit 82 and an inverting circuit 83. A first input terminal 82*a* out of two input terminals 82*a* and 82*b* of the exclusive OR circuit 82 is connected to the output side of the tag detection circuit 24, and a second input terminal 82*b* is connected to the ground side of the reed switch 17 respectively. The inverting circuit 83 is connected between the first input terminal 82*a* and tag detection circuit 24. In addition, the output terminal 82*c* of the exclusive OR circuit 82 is connected to a second buzzer 86, which is information means, through a time constant circuit 84.

If ON signals "1" or OFF signals "0" are inputted to all of the first and second input terminals 82*a* and 82*b* of the exclusive OR circuit 82, the exclusive OR circuit 82 outputs the signal "0". If the signal "0" is inputted to either of the first or second input terminal 82*a* or 82*b* and the signal "1" is inputted to the other terminal, the exclusive OR circuit 82 outputs the signal "1". Thus, the exclusive OR cuircuit 82 has the input and output relation shown in Table 1.

TABLE 1

| 1st Input | 2nd Input | Output |
|---|---|---|
| 0 | 0 | 0 |
| 0 | 1 | 1 |

TABLE 1-continued

| 1st Input | 2nd Input | Output |
|---|---|---|
| 1 | 0 | 1 |
| 1 | 1 | 0 |

If the signal "0" is inputted, the inverting circuit 83 outputs the signal "1", and if the signal "1" is imputed, the inverting circuit 83 outputs the signal "0". In addition, the second buzzer 86 is constructed to have a tone different than that of the first buzzer 18 that is the alarm means. The buzzer 86 is not activated if the exclusive OR circuit 82 outputs the signal "0", and is activated if outputting the signal "1". In addition, as information means, a lamp and the like can be used instead of the buzzer. Furthermore, the time constant circuit 84 consists of a resistor 84*a* and a capacitor 84*b*, and absorbs a time lag between the tag detection circuit 24 and reed switch 17. Thus, even if the outputs of the tag detection circuit 24 and reed switch 17 instantly become unstable due to the time lag at the time of drawing or containing the drawer 14 and hence the exclusive OR circuit 82 outputs the signal "1" in an instant, the second buzzer 86 is not activated owing to the time constant circuit 84. In addition, the time constant circuit 84 has a function of preventing the second buzzer 86 from being activated when external noise that is intermittent is received. The construction except the above construction is the same as that of the first embodiment.

The operation of the radio wave type burglar detection apparatus constructed like this will be described.

[A] A Case that All of the Tag 11, Tag Detection Sensor 16, and Reed Switch 17 Normally Operate Since the tag 11 does not face to the antenna 23 if the drawer 14 is contained in the safe 13, the tag detection sensor 16 cannot detect the tag 11, and hence the tag detection circuit 24 outputs the ON signal "1". This ON signal "1" from the tag detection circuit 24 is inverted by the inverting circuit 83 and is outputted to the first input terminal 82*a* of the exclusive OR circuit 82. On the other hand, the reed switch 17 is turned off because the reed switch 17 is separated from the magnet 27, and hence the OFF signal "0" is outputted to the second input terminal 82*b* of the exclusive OR circuit 82. In consequence, the exclusive OR circuit 82 outputs the signal "0" to the second buzzer 86, and hence the second buzzer 86 is not activated. At this time, since the output of the tag detection circuit 24 is the signal "0" and the output of the reed switch 17 is the signal "0", the first buzzer 18 is not activated.

In addition, if the drawer 14 is drawn from the safe 13, the tag 11 faces to the antenna 23, the tag detection sensor 16 detects the tag 11, and the tag detection circuit 24 outputs the OFF signal "0". This output "0" from the tag detection circuit 24 is inverted by the inverting circuit 83 into the signal "1" to be outputted to the first input terminal 82*a* of the exclusive OR circuit 82. On the other hand, since the reed switch 17 is turned on because the magnet 27 accesses the reed switch 17, the ON signal "1" is outputted to the second input terminal 82*b* of the exclusive OR circuit 82. In consequence, since the exclusive OR circuit 82 outputs the signal "0" to the second buzzer 86, the second buzzer 86 is not activated. At this time, since the output of the tag detection circuit 24 is the signal "0" and the output of the reed switch 17 is the signal "1", the first buzzer 18 is not activated.

Furthermore, if the two tags 11 and 11 are taken out from the drawer 14 in the state of the drawer 14 being drawn from the safe 13, the tag detection sensor 16 does not detect the tag 11 because the tag 11 does not face to the antenna 23, and hence the tag detection circuit 24 outputs the ON signal "1". This output "1" from the tag detection circuit 24 is inverted into the signal "0" by the inverting circuit 83 to be outputted to the first input terminal 82*a* of the exclusive OR circuit 82. On the other hand, since the reed switch 17 keeps the state of accessing the magnet 27, the reed switch 17 outputs the ON signal "1" to the second input terminal 82*b* of the exclusive OR circuit 82. In consequence, since the exclusive OR circuit 82 outputs the signal "1" to the second buzzer 86, the second buzzer 86 is activated in a tone different from that of the first buzzer 18. At this time, since the output of the tag detection circuit 24 is the signal "1" and the output of the reed switch 17 is the signal "1", the first buzzer 18 is activated. Thus, if the bank notes 15 in the safe 13 are taken out without notice, not only the first buzzer 18 but also the second buzzer is activated. Nevertheless, since the tag 11 is taken out with the bank notes 15 from the drawer 14, it is possible to judge that the bank notes 15 are taken out without notice.

[B] A Case that the Tag Detection Sensor 16 Abnormally Operates Due to a Failure A tag detection sensor 16 abnormally operates due to abnormal oscillation of a voltage-controlled oscillator (not shown), abnormal operation of an amplifier (not shown), or a failure or disconnection of a wire of another part constructing the tag detection sensor 16. Therefore, in spite of the tag 11 not facing to the antenna 23, the tag detection circuit 24 outputs the OFF signal "0" as if the tag detection sensor 16 detected the tag 11. This output "0" from the tag detection circuit 24 is inverted into the signal "1" by the inverting circuit 83 to be inputted to the first input terminal 82*a* of the exclusive OR circuit 82. On the other hand, since the normal reed switch 17 is turned off because the reed switch 17 is separated from the magnet 27, the reed switch 17 outputs the signal "0" to the second input terminal 82*b* of the exclusive OR circuit 82. In consequence, since the exclusive OR circuit 82 outputs the signal "1" to the second buzzer 86, the second buzzer 86 is activated in a tone different from that of the first buzzer 18. At this time, since the output of the tag detection circuit 24 is the signal "0" and the output of the reed switch 17 is the signal "0", the first buzzer 18 is not activated.

In addition, if the drawer 14 is drawn from the safe 13, the tag detection sensor 16 abnormally operates and the tag detection circuit 24 outputs the signal "1", which is the signal showing absence of the tag 11, in spite of the tag 11 facing to the antenna 27. This output "1" from the tag detection circuit 24 is inverted into the signal "0" by the inverting circuit 83 to be inputted to the first input terminal 82*a* of the exclusive OR circuit 82. On the other hand, since the normal reed switch 17 is turned on because the magnet 27 accesses the reed switch 17, the reed switch 17 outputs the signal "1" to the second input terminal 82*b* of the exclusive OR circuit 82. In consequence, since the exclusive OR circuit 82 outputs the signal "1" to the second buzzer 86, the second buzzer 86 is activated. At this time, since the output of the tag detection circuit 24 is the signal "0" and the output of the reed switch 17 is the signal "1", the first buzzer 18 is not activated.

[C] A Case that the Reed Switch 17 Abnormally Operates Due to a Failure

Since the tag 11 does not face to the antenna 23 if the drawer 14 is contained in the safe 13, the tag detection sensor 16 cannot detect the tag 11, and hence the tag detection circuit 24 outputs the ON signal "1". This ON signal "1" from the tag detection circuit 24 is inverted into the signal "0" by the inverting circuit 83 and is outputted to the first input terminal 82*a* of the exclusive OR circuit 82. On the other hand, the reed switch 17, which abnormally operates due to a contact failure, a short-circuit of wiring, and the like, is turned on in spite of the magnet 27 being separated from the reed switch 17. Hence, the OFF signal "0" is outputted to the second input terminal 82*b* of the exclusive OR circuit 82. In consequence, the exclusive OR circuit 82 outputs the signal "1" to the second buzzer 86, and hence the second buzzer 86 is activated. At this time, since the output of the tag detection circuit 24 is the signal "1" and the output of the reed switch 17 is the signal "1", the first buzzer 18 is activated. Nevertheless, since the first and second buzzer 18 and 86 are activated in the state of the drawer 14 being contained in the safe 13, it is possible to judge that the reed switch 17 is failed.

In addition, if the drawer 14 is drawn from the safe 13, the tag 11 faces to the antenna 23, the tag detection sensor 16 detects the tag 11, and the tag detection circuit 24 outputs the OFF signal "0". This output "0" from the tag detection circuit 24 is inverted by the inverting circuit 83 into the signal "1", to be outputted to the first input terminal 82*a* of the exclusive OR circuit 82. On the other hand, since the reed switch 17, which abnormally operates, is turned off in spite of the magnet 27 accessing the reed switch 17, the signal "0" is outputted to the second input terminal 82*b* of the exclusive OR circuit 82. In consequence, since the exclusive OR circuit 82 outputs the signal "1" to the second buzzer 86, the second buzzer 86 is activated. At this time, since the output of the tag detection circuit 24 is signal "0" and the output of the reed switch 17 is the signal "0", the first buzzer 18 is not activated.

[D] A Case that the Tag 11 Abnormally Operates Due to a Failure

Even if the tag 11 is failed due to disconnection of a wire and the like if the drawer 14 is contained in the safe 13, this tag 11 does not face to the antenna 27, and hence the normal tag detection sensor 16 cannot detect the tag 11. Hence, the tag detection circuit 24 outputs the ON signal "1". This ON signal "1" from the tag detection circuit 24 is inverted into the signal "0" by the inverting circuit 83 and is outputted to the first input terminal 82*a* of the exclusive OR circuit 82. On the other hand, the normal reed switch 17 is turned off since the magnet 27 is separated from the reed switch 17, and hence, the OFF signal "0" is outputted to the second input terminal 82*b* of the exclusive OR circuit 82. In consequence, the exclusive OR circuit 82 outputs the signal "0" to the second buzzer 86, and hence the second buzzer 86 is not activated. At this time, since the output of the tag detection circuit 24 is the signal "1" and the output of the reed switch 17 is the signal "0", the first buzzer 18 is not activated.

Nevertheless, if the drawer 14 is drawn from the safe 13, the normal tag detection sensor 16 cannot detect the failed tag 11 in spite of the tag 11 facing to the antenna 27, and hence the tag detection circuit 24 outputs the signal "1". This output "1" from the tag detection circuit 24 is inverted by the inverting circuit 83 into the signal "0" to be outputted to the first input terminal 82*a* of the exclusive OR circuit 82. On the other hand, since the normal reed switch 17 is turned on since the magnet 27 accesses the reed switch 17, the signal "1" is outputted to the second input terminal 82*b* of the exclusive OR circuit 82. In consequence, since the exclusive OR circuit 82 outputs the signal "1" to the second buzzer 86, the second buzzer 86 is activated. At this time, since the output of the tag detection circuit 24 is signal "1" and the output of the reed switch 17 is the signal "1", the first buzzer 18 is activated. Nevertheless, although the first and second buzzers 18 and 86 are activated in the state of the drawer 14 being drawn from the safe 13, the tag 11 is present in the drawer 14, and hence it is possible to judge that the tag 11 is failed.

In this manner, if the tag detection sensor 16, reed switch 17, or tag 11 abnormally operates due to a failure and the like, the self operation management circuit 81 immediately detects this abnormal operation and activates the second buzzer 86. Therefore, an owner of the safe 13 can instantly know the failure of the radio wave type burglar detection apparatus. Hence, since it is possible to repair or replace this apparatus failed or malfunctioned, it is possible to increase the reliability of the radio wave type burglar detection apparatus of the present invention. In addition, by transmitting the output of the self operation management circuit 81 with the output of the AND circuit 19 (control circuit) to a security guard company or the like, personnel of the security guard company or the like, which receives the alarm, go to the location, and can judge whether the alarm is an alarm or a failure.

Figure 10:
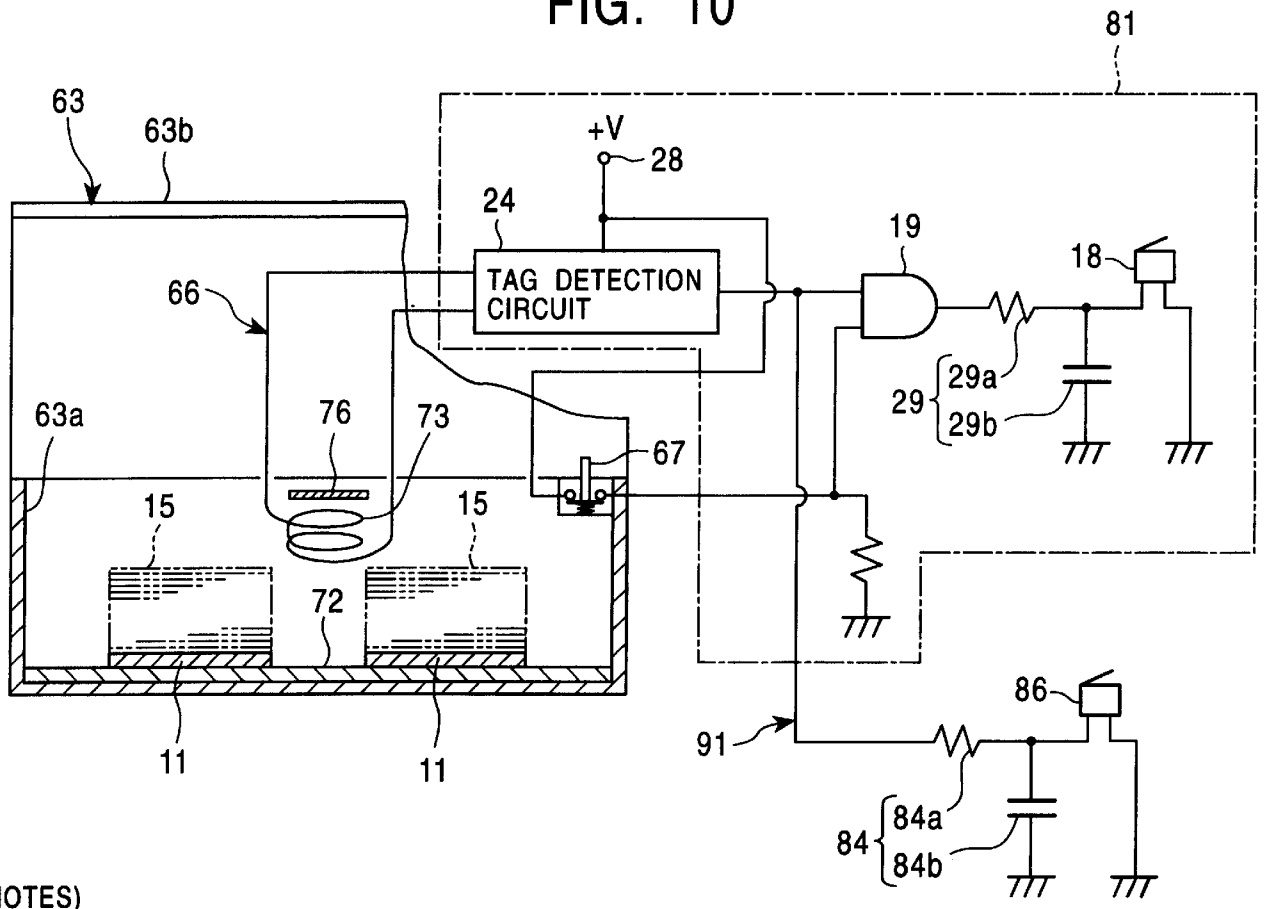
FIG. 10 is a block diagram that corresponds to FIG. 7 and shows a radio wave type burglar detection apparatus that comprises a self operation management circuit and is a fifth embodiment of the present invention.

FIG. 10 shows a fifth embodiment of the present invention. In FIG. 10, the same symbols of FIG. 7 are assigned to the same components.

This embodiment comprises a self operation management circuit 91 detecting abnormal operation of the tag 11 or tag detection sensor 66. This self operation management circuit 91 is a branch circuit branching from the output side of the tag detection circuit 24. The second buzzer 86 that is information means is connected to this branch circuit 91 through the time constant circuit 84 composed of the resistor 84*a* and capacitor 84*b*. The time constant circuit 84 has a function of preventing the second buzzer 86 from being activated when receiving intermittent external noise. In addition, a lamp or the like can be used as information means instead of the buzzer. The construction except the above construction is the same as that of the third embodiment.

The operation of the radio wave type burglar detection apparatus constructed like this will be described.

[E] A Case That Both of the Tag 11 and Tag Detection Sensor 66 Normally Operate If the upper lid 63*b* is closed, the tag 11 faces to the loop antenna 73, and hence the tag detection sensor 66 detects that the tags 11 and 11 are present in the safe 63, and the tag detection circuit 24 outputs the OFF signal "0". Therefore, the self operation management circuit 91 does not activate the second buzzer 86. At this time, since the output of the tag detection circuit 24 is the signal "0" and the output of the micro switch 67 is the signal "0", the first buzzer 18 is not activated.

In addition, even if the upper lid 64*b* is opened, the tag 11 faces to the loop antenna 73, and hence, similarly to the above, the tag detection circuit 24 outputs the OFF signal "0". In consequence, the self operation management circuit 91 does not activate the second buzzer 86. At this time, since the output of the tag detection circuit 24 is the signal "0" and the output of the micro switch 67 is the signal "1", the first buzzer 18 is not activated.

In addition, if the two tags 11 and 11 are taken out from the safe 63 in the state of the upper lid 64*b* being opened, the tag 11 does not face to the loop antenna 73, and hence the tag detection sensor 66 does not detect the tag 11. Hence, the tag detection circuit 24 outputs the ON signal "1", and the self operation management circuit 91 activates the second buzzer 86 in a tone different from that of the first buzzer 18. At this time, since the output of the tag detection circuit 24 is the signal "1" and the output of the micro switch 67 is the signal "1", the first buzzer 18 is activated. Thus, if the bank notes 15 in the safe 63 are taken out with the tag 11 without notice, not only the first buzzer 18 but also the second buzzer 86 are activated. Nevertheless, since the tag 11 is taken out with the bank notes 15 from the safe 63, it is possible to judge that the bank notes 15 are taken out without notice.

[F] A Case That the Tag Detection Sensor 66 Abnormally Operates Due to a Failure If the upper lid 63*b* is closed, a tag detection sensor 66 abnormally operates due to abnormal oscillation of a voltage-controlled oscillator (not shown), abnormal operation of an amplifier (not shown), or a failure or disconnection of a wire of another part constructing the tag detection sensor 66. Therefore, in spite of the tag 11 facing to the loop antenna 73, the tag detection circuit 24 outputs the ON signal "1" as if the tag detection sensor 66 did not detect the tag 11. Hence, the self operation management circuit 91 activates the second buzzer 86. At this time, since the output of the tag detection circuit 24 is the signal "1" and the output of the micro switch 67 is the signal "0", the first buzzer 18 is not activated.

In addition, if the upper lid 63*b* is opened, the tag detection sensor 66 outputs the signal "1", which shows that the tag 11 is not detected, in spite of the tag 11 facing to the loop antenna 73. Hence, the self operation management circuit 91 activates the second buzzer 86. At this time, since the output of the tag detection circuit 24 is the signal "1" and the output of the micro switch 67 is the signal "1", the first buzzer 18 is activated.

[G] A Case That the Tag 11 Abnormally Operates Due to a Failure

If the tag 11 is failed due to disconnection of a wire and the like when the upper lid 63*b* is closed, the normal tag detection sensor 66 cannot detect the tag 11 in spite of the tag 11 facing to the loop antenna 73, and hence the tag detection circuit 24 outputs the ON signal "1". Therefore, the self operation management circuit 91 activates the second buzzer 86. At this time, since the output of the tag detection circuit 24 is the signal "1" and the output of the micro switch 67 is the signal "0", the first buzzer 18 is not activated.

In addition, if the upper lid 63*b* is opened, the tag detection circuit 24 outputs the signal "1" in spite of the tag 11, similarly to the above, facing to the loop antenna 73. Hence, the self operation management circuit 91 activates the second buzzer 86. At this time, since the output of the tag detection circuit 24 is the signal "1" and the output of the micro switch 67 is the signal "1", the first buzzer 18 is activated.

If the tag 11 is present in the safe 63 like the above-described examples [F] and [G] and the second buzzer 86 is activated regardless of open and close of the upper lid 63*b*, it is possible to judge that the tag detection sensor 66 or tag 11 is failed.

In this manner, if the tag detection sensor 66 or tag 11 abnormally operates due to a failure and the like, the self operation management circuit 91 immediately detects this abnormal operation and activates the second buzzer 86. Therefore, an owner of the safe 63 can instantly know the failure of the radio wave type burglar detection apparatus. Hence, since it is possible to repair or replace this apparatus failed or malfunctioned, it is possible to increase the reliability of the radio wave type burglar detection apparatus of the present invention. In addition, by transmitting the output of the self operation management circuit 91 with the output of the AND circuit 19 (control circuit) to a security guard company or the like, personnel of the security guard company or the like, which receives the alarm, go to the location, and can judge whether the alarm is an alarm or a failure.

In addition, although a safe is cited as a box in the first through fifth embodiments, a show window case for displaying precious metal, a cash register that is a terminal of a POS (Point Of Sales) system, and the like also can be used as the box. In addition, although a buzzer is cited as alarm means in the first through third embodiments, a lamp or other alarm means also can be used, and this alarm means can be installed in a security guard company and the like. In this case, since the security guard company and the like can immediately know a burglar and the like of bank notes from a safe, the company can correspond to this matter immediately.

Furthermore, although a first buzzer is cited as alarm means and a second buzzer is cited as information means in the fourth and fifth embodiments, a lamp and other alarm means can be used as the alarm means and a lamp and other information means can be used as the information means.

Moreover, although plenty of bank notes are piled on a tag in the first through fifth embodiments, checks, important papers, and the like can be placed, and a bundle of a tag, plenty of bank notes, and the like can be contained in one piece in a drawer or the box. In this case, if the bank notes and the like are taken out from the drawer or box, the tag is always taken out with them, and hence it is possible to surely detect a burglar of the bank notes and the like. In addition, if the objects to be contained in a safe are metals such as bar gold and precious metal articles, a radio wave is cut off with the metals in case of these metals being placed of the tag. Hence, it is preferable to place the metal beside the tag and to bind the metal to the tag.

In addition, although two tags are contained in a drawer or a box in the first through fifth embodiments, one or three tags also can be contained. If three or more tags are contained, it is necessary to extend an antenna without using a pair of arm sections in the first, second, and fourth embodiments. Nevertheless, since the antenna in the third embodiment is a loop antenna, all tags can be detected without extending the antenna.

Furthermore, a core or a loop antenna of a tag detection sensor are covered with both of a wave absorber and an electromagnetic wave shielding member in the first through fifth embodiments, either of the wave absorber or electromagnetic wave shielding member can be used for covering.

Moreover, a loop antenna can be used as the antenna in the first and second embodiments, and a core where a coil is wound can be used as the antenna in the third embodiment.

In addition, the figures of the resonance frequency cited in the first embodiment are examples, and hence the present invention is not limited to this range.

Moreover, the self operation management circuit cited in the fourth embodiment can be provided in the radio wave type burglar detection apparatus according to the second embodiment.

INDUSTRIAL APPLICABILITY

As described above, according to the present invention, a radio wave type burglar detection apparatus has such a construction that a tag having a resonance circuit block is placed with an object in a predetermined location, a tag detection sensor that is installed near the tag placed in this predetermined location detects whether the tag is present in the predetermined place, and a control circuit controls alarm means on the basis of the detection output of this sensor. Hence, if the tag is placed with the object in the predetermined location, the control circuit does not activate the alarm means on the basis of the detection output of the tag detection sensor. If the tag is taken out with the object from the predetermined location, the control circuit activates the alarm means on the basis of the detection output of the tag detection sensor. In consequence, it is possible to surely detect whether the tag is present in the predetermined location.

In addition, by containing a tag, which has a resonance circuit block, with an object in a drawer, containing this drawer in a box, detecting by a tag detection sensor, which is installed in this box, whether the tag is present in the drawer, detecting by a drawer sensor whether the drawer is drawn, and controlling alarm means by a control circuit, the drawer sensor detects that the drawer is not drawn regardless of the tag being present in the drawer if the box contains the drawer. Hence, the control circuit does not activate the alarm means. Furthermore, if the drawer is drawn from the box, the drawer sensor detects that the drawer is drawn, and the tag detection sensor detects that the tag is present in the drawer. Therefore, the control circuit does not activate the alarm means. Moreover, if the tag is taken out with the object from the drawer with the drawer being drawn, the tag detection sensor detects that the tag is absent in the drawer. Hence, the control circuit activates the alarm means. In consequence, it is possible to surely detect whether the tag is taken out from the drawer.

Furthermore, by containing a tag, which has a resonance circuit block, with an object in a box having an upper lid that can be opened and closed, detecting whether the tag is present in the box by a tag detection sensor installed in the box, detecting open and close of the upper lid by an upper lid sensor, and controlling alarm means on the basis of respective detection outputs of these sensors by a control circuit, the upper lid sensor detects regardless of presence or absence of the tag in the box that the upper lid is not opened if the upper lid is closed. Therefore, the control circuit does not activate the alarm means. Moreover, if the upper lid is opened, the upper lid sensor detects that the upper lid is opened, and the tag detection sensor detects that the tag is present in the box. Hence, the control circuit does not activate the alarm means. In addition, if the tag is taken out with the object from the box with the upper lid being opened, the tag detection sensor detects that the tag is absent in the box, and hence the control circuit activates the alarm means. In consequence, it is possible to surely detect whether the tag is taken out from the box.

Moreover, by placing a tag and an object in one piece in a predetermined location, or containing the tag with the object in one piece in a drawer or a box, the tag is always taken out from the predetermined location or from the drawer or box if the object is taken out from-the predetermined location or from the drawer or box. Therefore, it is possible to surely detect a burglar of the object.

In addition, if a drawer or a box is made of metal material, a magnetic field easily passes to the resonance circuit block of the tag by means of a soft magnetic member by sandwiching a soft magnetic member made of a sintered ferrite, a compact of ferrite powder and binder, or composite material of soft magnetic metal powder between the tag and drawer or box. Therefore, even if the drawer or box is made of metal material, it is possible to surely detect the tag by the tag detection sensor.

Furthermore, by covering a ferrite core, where a coil of a tag detection sensor is wound, and at least a part of a loop antenna, which does not face to a tag, with an wave absorber and an electromagnetic wave shielding member, electrical noise is absorbed by the wave absorber and is cut off by the electromagnetic wave shielding member even if the radio wave type burglar detection apparatus of the present invention is installed in a location with plenty of electrical noise of a computer and the like. Therefore, it is possible to block injection of the electrical noise into the core of the tag detection sensor or the loop antenna, and hence it is possible to prevent the apparatus from malfunctioning.

Moreover, by providing a pair of arm sections in both sides of a core with protruding toward a tag, it is possible to make a radio wave, which is transmitted from these arm sections, have directivity. Therefore, it is possible to increase a ratio (S/N ratio) between a signal transmitted from the arm sections and a signal generated by electrical noise of a computer and the like. In consequence, it is possible to increase the sensitivity of the tag detection sensor, and hence to surely detect presence and absence of the tag by the tag detection sensor.

In addition, by detecting the abnormal operation of a tag, a tag detection sensor, a drawer sensor, or an upper lid sensor by a self operation management circuit, the self operation management circuit immediately detects the abnormal operation if the tag or the like abnormally operates due to a failure or the like. Therefore, it is possible to rapidly repair or replace the tag or the like that abnormally operates. In consequence, it is possible to increase the reliability of the radio wave type burglar detection apparatus of the present invention.

What is claimed is:

1. A burglar detection apparatus for detecting theft of an object contained in a box having a drawer, the apparatus comprising:

a tag including a resonance circuit, adapted to be associated with the object;

a tag detection sensor configured to detect whether the tag is in the drawer, and to provide a tag detection output;

a drawer sensor configured to detect whether the drawer is open, and to provide a drawer sensor output; and a control circuit configured to control an alarm based on the tag detection output and the drawer sensor output.

2. The apparatus of claim 1, wherein the tag and the object are configured as one piece in the drawer.

3. The apparatus of claim 1, wherein the drawer is made of metal and the apparatus further comprises:

a soft magnetic member sandwiched between the tag and the drawer.

4. The apparatus of claim 3, wherein the soft magnetic member is made of a material selected from the group consisting of:

a sintered ferrite, a compact of ferrite powder or binder, and a composite material of soft magnetic metal powder.

5. The apparatus of claim 1, wherein the tag detection sensor includes:

a loop antenna having a surface, not facing the tag, that is covered by at least one of a wave absorber and an electromagnetic wave shielding member.

6. The apparatus of claim 1, wherein the tag detection sensor includes:

a ferrite core, a coil that is wound around the ferrite core, and at least one of a wave absorber and an electromagnetic wave shielding member configured to cover at least a part of the core that does not face the tag.

7. The apparatus of claim 6, further comprising:

a pair of ferrite arms provided at respective ends of the core and protruding toward the tag.

8. The apparatus of claim 1, further comprising:

a self-operation management circuit configured to detect abnormal operation of at least one of the tag, the tag detection sensor, and the drawer sensor.

9. A burglar detection apparatus for detecting theft of an object from a box that has a lid, the apparatus comprising:

a tag including a resonance circuit, adapted to be associated with the object;

a tag detection sensor configured to detect whether the tag is in the box, and to provide a tag detection output;

a lid sensor configured to detect whether the lid is open, and to provide a lid sensor output; and a control circuit configured to control an alarm based on the tag detection output and the lid sensor output.

10. The apparatus of claim 9, wherein the tag and the object are configured as one piece in the box.

11. The apparatus of claim 9, wherein the box is made of metal, and the apparatus further comprises:

a soft magnetic member sandwiched between the tag and the box.

12. The apparatus of claim 11, wherein the soft magnetic member is made of a material selected from the group consisting of:

a sintered ferrite, a compact of ferrite powder or binder, and a composite material of soft magnetic metal powder.

13. The apparatus of claim 9, wherein the tag detection sensor includes:

a loop antenna having a surface, not facing the tag, that is covered by at least one of a wave absorber and an electromagnetic wave shielding member.

14. The apparatus of claim 9, wherein the tag detection sensor includes:

a ferrite core, a coil that is wound around the ferrite core, and at least one of a wave absorber and an electromagnetic wave shielding member configured to cover at least a part of the core that does not face the tag.

15. The apparatus of claim 14, further comprising:

a pair of ferrite arms provided at respective ends of the core and protruding toward the tag.

16. The apparatus of claim 9, further comprising:

a self-operation management circuit configured to detect abnormal operation of at least one of the tag, the tag detection sensor, and the lid sensor.

17. A burglar detection apparatus for detecting theft of an object, the apparatus comprising:

a) a tag including a resonance circuit, adapted to be associated with the object;

b) a tag detection sensor configured to detect whether the tag is in a vicinity of the object, and to provide a tag detection output, wherein the tag detection sensor includes:

1) a ferrite core, 2) a coil that is wound around the ferrite core, and 3) at least one of a wave absorber and an electromagnetic wave shielding member configured to cover at least a part of the core that does not face the tag; and c) a control circuit configured to control an alarm based on the tag detection output.

18. The apparatus of claim 17, further comprising:

a pair of ferrite arms provided at respective ends of the core and protruding toward the tag.

19. The apparatus of claim 18, further comprising:

a self-operation management circuit configured to detect abnormal operation of at least one of the tag and the tag detection sensor.

20. The apparatus of claim 17, further comprising:

a self-operation management circuit configured to detect abnormal operation of at least one of the tag and the tag detection sensor.

21. A burglar detection apparatus for detecting theft of an object, the apparatus comprising:

a) a tag including a resonance circuit, adapted to be associated with the object;

b) a tag detection sensor configured to detect whether the tag is in a vicinity of the object, and to provide a tag detection output, wherein the tag detection sensor includes:

1) a loop antenna having a surface, not facing the tag, that is covered by at least one of a wave absorber and an electromagnetic wave shielding member; and c) a control circuit configured to control an alarm based on the tag detection output.

22. The apparatus of claim 21, further comprising:

a self-operation management circuit configured to detect abnormal operation of at least one of the tag and the tag detection sensor.

* * * * *